United States Patent [19]

Schäfer

[11] Patent Number: 5,018,639

[45] Date of Patent: May 28, 1991

[54] STORAGE CONTAINER FOR LOW-TEMPERATURE LIQUIDS

[75] Inventor: Hans Schäfer, Frankfurt, Fed. Rep. of Germany

[73] Assignee: Philipp Holzmann AG, Fed. Rep. of Germany

[21] Appl. No.: 511,415

[22] Filed: Apr. 20, 1990

[30] Foreign Application Priority Data

Apr. 22, 1989 [DE] Fed. Rep. of Germany ..... 3913253

[51] Int. Cl.[5] ..... E03B 11/00

[52] U.S. Cl. ..... 220/426; 220/428; 220/459; 165/104.19

[58] Field of Search ..... 220/426, 428, 429, 445, 220/459; 137/1, 592; 165/104.19; 60/659; 126/437

[56] References Cited

U.S. PATENT DOCUMENTS

| | | | |
|---|---|---|---|
| 3,109,294 | 11/1963 | Messen | 220/428 |
| 3,563,705 | 2/1971 | May | 165/104.19 |
| 3,606,067 | 9/1971 | Jones | 220/426 |
| 3,764,035 | 10/1973 | Silvgrman | 220/426 |
| 4,643,212 | 2/1987 | Rothrock | 165/104.19 |
| 4,939,878 | 7/1990 | Schuhbauer | 220/426 |

*Primary Examiner*—Joseph Man-Fu Moy
*Attorney, Agent, or Firm*—Glen R. Grunewald

[57] ABSTRACT

The invention relates to a container for the storage of low-temperature liquids, especially liquefied gases, consisting of an outer container made of reinforced or prestressed concrete, equipped perhaps with a steel dome, and an open inner steel tank, intended to hold the liquid, the steel tank resting on an insulator; an annular space is provided between the two tanks, this space containing a granular insulating material and, in its lower part, a spacer element. In order to protect the steel tank from sliding during an earthquake and in order to absorb the horizontal forces unleashed during such an event, an annular hollow container made of steel is installed between the spacer and the wall of the concrete container, to which it is firmly attached. This hollow container, filled partially with a material that is liquefiable by heating, has some heating elements. The spacer is attached firmly to the hollow container and it is also firmly or tensionally connected to the steel tank. The material in the hollow container, which is preferable a bitumen, is heated during filling and emptying of the steel tank, and consequently does not prevent the deformations of the steel tank caused by the temperature changes during filling and emptying.

3 Claims, 3 Drawing Sheets

STORAGE CONTAINER FOR LOW-TEMPERATURE LIQUIDS

Figure 1:
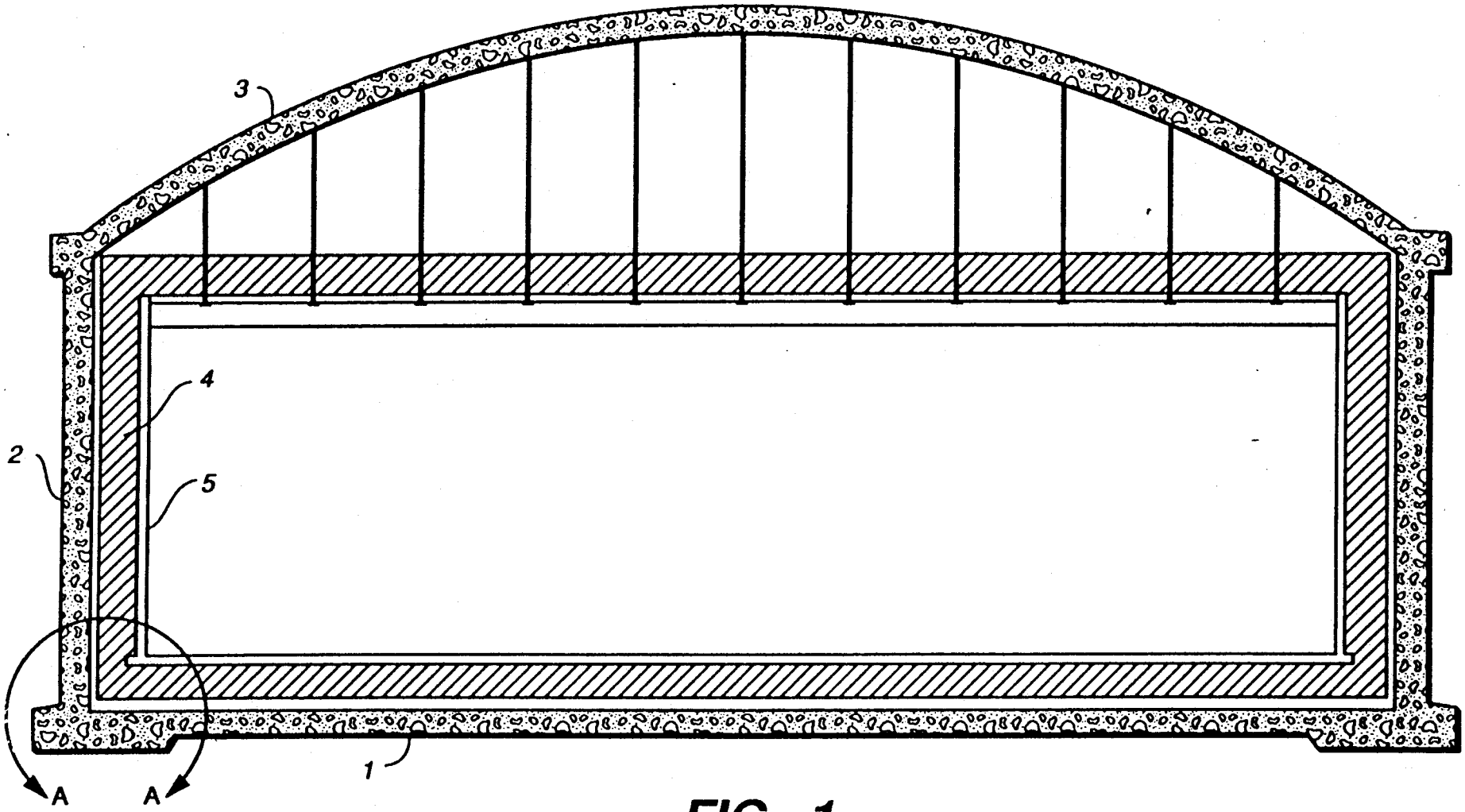

This invention relates to a container for the storage of low-temperature liquids, especially of liquefied gases, consisting of an outer container made of reinforced or prestressed concrete, closed on all sides, fitted perhaps with a steel dome, and an open inner steel container, intended to hold the liquid resting on an insulating material. The outside peripheral surface of the steel container is separated from the inside peripheral surface of the outer container by an annular space filled with a granular insulating material.

Such a container is known, for example, from German Patent (DE-PS) 3.1 25 846. Extensive safety precautions must be taken in operating such containers; they must be earthquake resistant, among other things. During an earthquake, the horizontal inertial forces must be transferred from the inner tank to the outer tank. Precautions must be taken to ensure that the insulation in the annular space between the two tanks does not contribute to this. Since this space is intended not only to contain the insulating material, but also to be accessible during upsets or for repairs, one generally uses expanded perlite as the insulating material. The starting material is here a volcanic silicate rock; when this rock is heated briefly to about 1000° C., the bound water is converted to steam and the glass melt swells to many times its volume.

A certain portion of the horizontal forces can be transferred by friction forces from the steel tank to the bottom of the outer container by way of the bottom insulation. In the case of strong earthquakes, the friction forces or the resistance to shear in the bottom cannot resist sliding of the inner tank. Once this tank, with its tremendous mass of liquid, starts sliding—which cannot be prevented by the perlite insulation in the annular space—it could strike the outer container with sufficient force to burst the steel tank and to damage or even destroy the outer tank. This can lead to very grave explosions and fires.

It is known that, in order to counteract the sliding of the steel tank, one can install on the bottom of the annular space between the two tanks a massive body, the thickness of which corresponds exactly to the width of the clearance. If the steel tank is filled with liquefied natural gas, for example, this operation is carried out at −165° C. As the steel tank is filled with the liquefied gas, the tank is also cooled to that temperature and shrinks correspondingly. In a steel tank with a capacity of 50,000 cubic meters and a diameter of about 45 m, the radius of the tank shrinks by about 5 cm; this in turn forms a new gap which could lead later, during an earthquake, to sliding and thus to the destruction of the bottom insulation and, under certain circumstances, of the tank itself.

The aim of this invention is to design a container of the type described above that would couple the inner and outer tanks in such a way as to prevent the presence of untoward forces during the time intervals between cold and ambient-temperature operation.

This problem is solved according to this invention by installing between the spacer element and the inside wall of the concrete container an annular hollow container made of sheet steel, which is attached rigidly to the outer container. This invention proposes furthermore that the hollow container be filled partially with a material that liquefies on heating; that heating elements be installed in the hollow container; and that the spacer element be made of steel; and that it be connected rigidly to the hollow container and either rigidly or frictionally to the steel tank.

The liquefiable material is preferably a bitumen. However, other plasticizable materials are also suitable, such as tin, or plastic materials that remain sufficiently tough in the solidified state under short-term stress, to absorb the horizontal forces sometimes present during an earthquake, without failing under this stress.

The spacer element need not be attached rigidly to the hollow container and to the steel tank; it may also be shaped as a disk, the exterior circumference of which is attached to the hollow container and on which the steel tank rests, separated by an intermediate layer, preferably of concrete, this layer being strong enough because of its high friction and thrust coefficients to prevent sliding.

In practice, the following procedure is followed: during filling or emptying of the steel tank, the material in the hollow container is liquefied by heating and the liquid state is maintained until the steel tank stops contracting or expanding. The inside wall of the hollow container joins in the expansion or contraction, i.e., the hollow container bulges inward during the contraction and returns to its original shape during the expansion. The liquefied material thus adapts to the form changes of the hollow container so that, at the end of the contraction or expansion, and of the subsequent solidification of the liquefied material, the bond between the inner and outer containers is unbroken.

Figure 2:
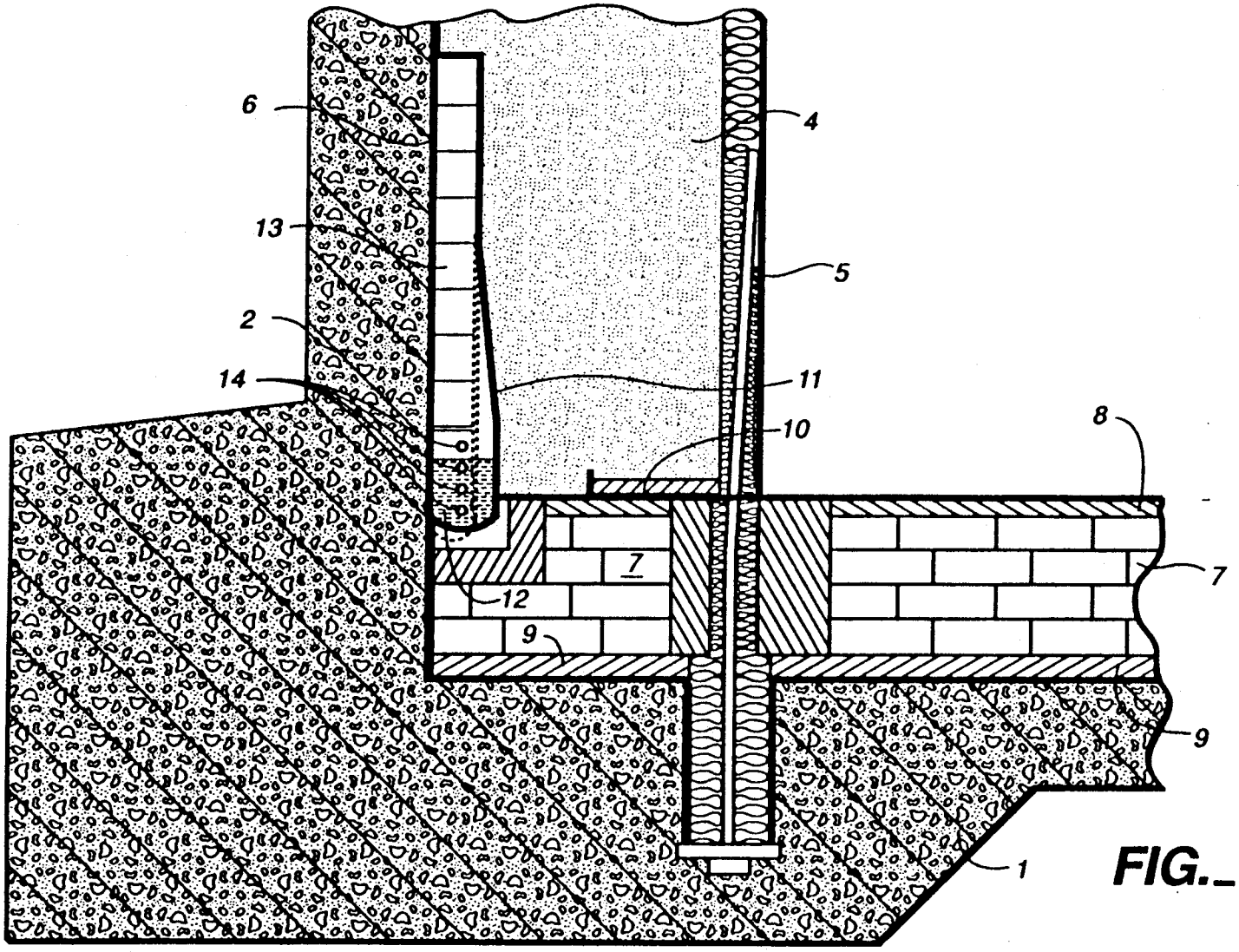
Figure 3:
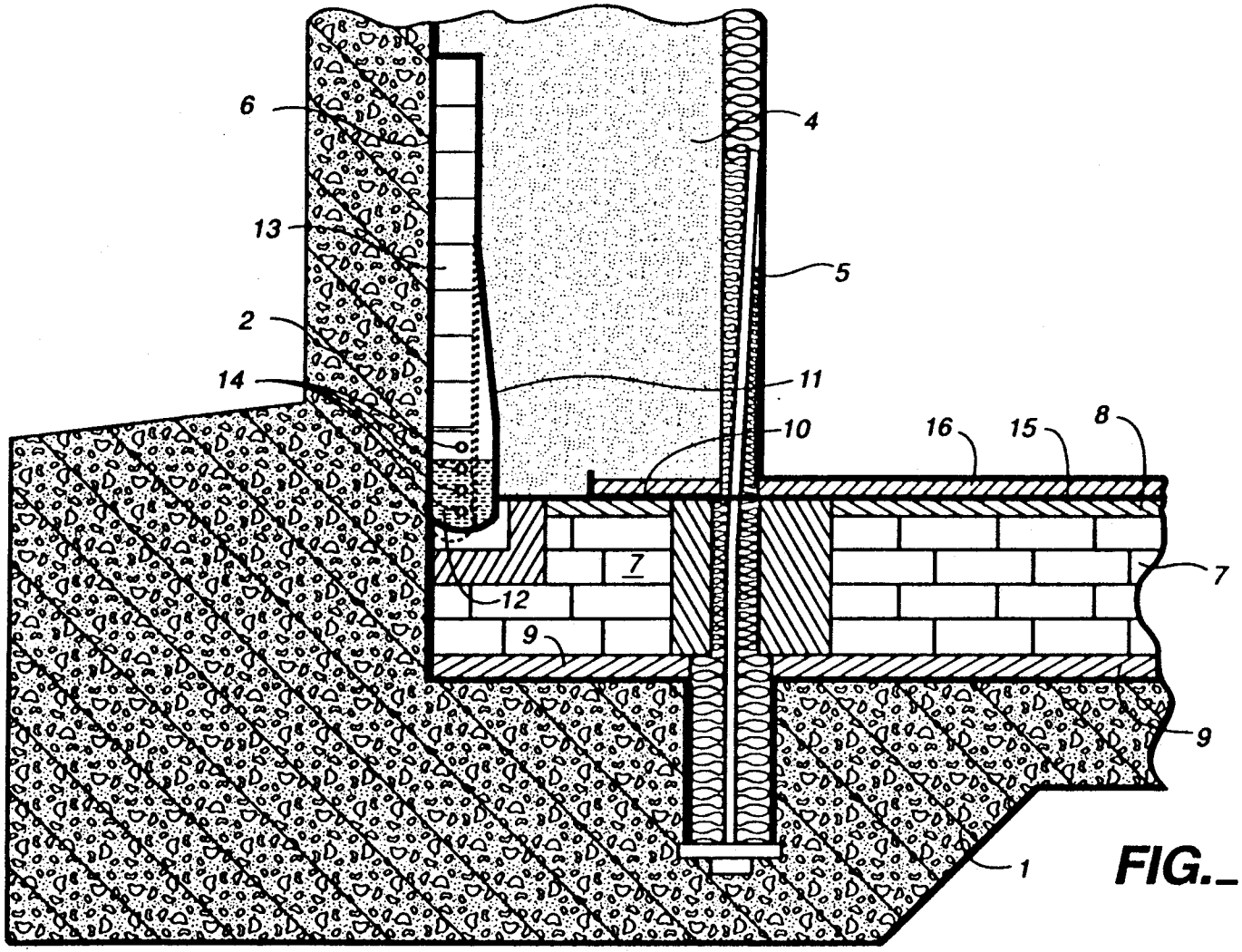

This invention is further elucidated by the exemplified embodiments in the drawing. Here, FIG. 1 is a cross section of a container for holding a liquified gas;

FIG. 2 is the detail A from FIG. 1, representing one embodiment of this invention; and FIG. 3 is the detail A from FIG. 1, representing another embodiment of this invention.

FIG. 1 shows an outer container made of reinforced concrete, consisting of a bottom plate 1, a wall 2, and a roof dome 3. A steel inner tank 5 is located inside the concrete container, and separated from it by insulation. The inner tank is open at the top: it is intended to store a liquefied gas. Such a container, with a holding capacity of 50,000 cubic meters, has a wall thickness of about 14 to 30 mm; the thickness of the insulation 4 is about one meter and the wall thickness of the reinforced-concrete container 2 is about 50 cm. The insulation below the bottom of the steel container consists of cellular (foam) glass, capable of bearing the static load of tank 5 filled with liquefied gas. The surface insulation consists of mineral wool. The annular space between the two containers is filled with perlite granules. The non-combustible perlite granules have the advantage of being easily poured into the annular space. Conversely, they are just as readily sucked out, if this should become necessary for the purpose of inspection or repairs.

In the embodiment example according to FIG. 2, a steel liner 6 is attached to the inside of the reinforced concrete tank 1, 2. This liner ensures gas impermeability and serves at the same time as a vapor lock. Steel tank 5 rests on bottom 1 of the reinforced-concrete container, from which it is separated by foam glass insulation 7. Intermediate layers 8 and 9 are arranged respectively between liner 6 and insulation 7, and between the bottom of the steel tank 5 and the insulation 7. At the lower end of the perlite-containing space between wall 2 of the reinforced-concrete container and the wall of the steel tank 5 is arranged an annular spacer element 10, which is attached, on the inside, to the steel tank 5 and, on the outside, to the lower portion of the inside wall of a hollow container 11, made of sheet steel, and connected to liner 6. Both the inside wall of the hollow container 6 and the spacer element 10 are made of cryogenic steel.

In the lower portion of the hollow container 11, connected to the spacer 10, is a material 12 which is in the solid state both when tank 5 is full or empty. This material 12 as well as the spacer 10 are there to provide support for steel tank 5 in case the latter is subjected to horizontal forces during an earthquake. The hollow container 11 contains, at some distance from material 12, insulating foam-glass elements 13, which form a temperature gradient from the cold bottom of steel tank 5 to the wall 2 of the reinforced-concrete container.

The material 12 in the hollow container 11 consists preferably of a bitumen, though other materials may also be used. These materials must be plasticizable under the influence of heat. They must also be sufficiently hard and tough in the range between the ambient and operating temperatures to transfer the horizontal forces generated by an earthquake and to keep the steel tank and the spacer element 10 in equilibrium.

Heating coils are provided in the lower part of hollow container 11 in order to liquefy material 12. These coils may be heated by electric current, by induction, or by a heating medium flowing through them to a sufficiently high temperature to cause the surrounding material to melt.

FIG. 2 shows the case in which the steel tank 5 has been filled with liquefied gas, which caused it to shrink. The consequence of this contraction is that the outer wall of the hollow container 11 bulges out from the normal position, indicated by the dotted line, to the position shown. In much the same way, the wall of the hollow container 11 returns to the dotted position when the steel tank is emptied. The viscous bitumen heated during filling and emptying does not interfere with the temperature-induced deformations of the steel tank, while during normal (cold) operation, the bitumen forms a stiff, tensionally resistant abutment against horizontal stresses. This leads, in effect, to adjustable impacts.

FIG. 3 shows the detail A from FIG. 1 for another embodiment example. The reference numerals in the drawing are the same as in FIG. 2. This example differs from that in FIG. 2 in that the spacer element here consists of a disk, the outer periphery of which is rigidly connected to the hollow container 11 and which covers the entire surface under steel tank 5. A concrete layer 16 separates disk 15 from the bottom of the steel container. The coupling of the space element 15 with the steel tank is accomplished tensionally through friction, without in any way affecting the performance, as described in the embodiment of FIG. 2.

I claim:

1. In a container for storage, of a low-temperature liquid, said container having an outer container closed on all sides and an inner, steel container to hold said liquid, said inner container spaced from said outer container by an annular space filled with granular insulating material, said inner container supported on insulation, and a spacer element at the bottom of said annular space, the improvement comprising:

an annular container (11) positioned at the bottom of and within said annular space between said outer container (1) and said spacer element (10, 15), said annular container containing a material (12), liquefiable by heat, and a heating element (14), said spacer element being in contact with said inner container and with said annular container.

2. The container of claim 1 wherein said liquefiable material is bitumen.

3. The container of claim 1 wherein said spacer element is a disc (15), the outer circumference of which is connected with said annular container (11); the upper surface of said disc is coated with an intermediate layer of material having high friction and thrust coefficients and said inner container (5) is supported on said intermediate layer, whereby said inner container is protected from sliding.

* * * * *